US006544104B1

(12) United States Patent
Koike et al.

(10) Patent No.: US 6,544,104 B1
(45) Date of Patent: Apr. 8, 2003

(54) POLISHING PAD AND POLISHER

(75) Inventors: Hisao Koike, Kameyama (JP); Takeshi Arai, Fuji (JP); Akihiko Ikeda, Fuji (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/049,664

(22) PCT Filed: Aug. 25, 2000

(86) PCT No.: PCT/JP00/05762

§ 371 (c)(1),
(2), (4) Date: Feb. 15, 2002

(87) PCT Pub. No.: WO01/15861

PCT Pub. Date: Aug. 3, 2001

(30) Foreign Application Priority Data

Aug. 27, 1999 (JP) ..... 11-242195

(51) Int. Cl.[7] ..... B24B 49/00

(52) U.S. Cl. ..... 451/9; 451/6; 451/10; 451/41; 451/285; 451/287; 451/526

(58) Field of Search ..... 451/6, 8, 9, 10, 451/11, 41, 285, 287, 289, 526, 527, 533

(56) References Cited

U.S. PATENT DOCUMENTS 5,605,760 A 2/1997 Roberts
5,609,511 A * 3/1997 Moriyama et al. ..... 451/5
5,838,448 A * 11/1998 Aiyer et al. ..... 356/382
5,893,796 A 4/1999 Birang et al.
5,964,643 A 10/1999 Birang et al.
6,045,439 A 4/2000 Birang et al.
6,077,452 A * 6/2000 Litvak ..... 216/85
6,224,460 B1 * 5/2001 Dunton et al. ..... 541/6
6,247,998 B1 * 6/2001 Wiswesser et al. ..... 451/6
6,366,639 B1 * 4/2002 Ezaki et al. ..... 378/34
6,383,058 B1 * 5/2002 Birang et al. ..... 451/41

FOREIGN PATENT DOCUMENTS

EP 0 824 995 A1 2/1998
JP 6-59102 A 3/1994
WO 99/64205 A1 12/1999

* cited by examiner

*Primary Examiner*—Eileen P. Morgan
(74) *Attorney, Agent, or Firm*—Birch, Stewart, Kolasch & Birch, LLP.

(57) ABSTRACT

A window member (11) having an intentionally designed distribution of refractive index is used, as a transparent window member in a light transmission area of a polishing pad for detecting the end point of polishing by a CMP method.

This window member (11) has areas (11*a*) having a high refractive index and areas (11*b*) having a low refractive index in its window face. In a cross section normal to the window face, the high-refractive index areas (11*a*) and the low-refractive index areas (11*b*) are alternately arranged in stripes. These areas (11*a* and 11*b*) in the window face are in a Fresnel zone plate arrangement in which the first area (center circle) is a bright one (area having a high refractive index). A plurality of such Fresnel zone plates (F) are arrayed in a matrix in the window face of the window member (11).

20 Claims, 6 Drawing Sheets

POLISHING PAD AND POLISHER

This application is the national phase under 35 U.S.C. §371 of PCT International Application No. PCT/JP00/05762 which has an International filing date of Aug. 25, 2000, which designated the United States of America.

TECHNICAL FIELD

The present invention relates to a polishing pad for chemical mechanical polishing.

BACKGROUND ART

In manufacturing a semiconductor device, a step of forming an conductive film over the surface of a wafer is followed by a step of forming a wiring layer by photolithography, etching or the like and a step of forming an inter-layer insulation film over the wiring layer. These steps produce non-uniformity of the wafer surface. As fineness of wiring is increased and multi-layered wiring is used in recent years for higher density semiconductor integrated circuits, a technique for planarizing a non-uniform wafer surface has been important.

Methods for planarizing a non-uniform wafer surface include what is known as a chemical mechanical polishing (CMP) method. In the CMP method, slurry in which abrasive grains are dispersed in a liquid is used as a polishing solution, the surface of the wafer to be polished is pressed against the polishing surface of a polishing pad and polished.

A polisher for use by the CMP method is provided with, for instance a polishing table 2 for supporting a polishing pad 1, a supporting base 6 for supporting an object (wafer) 5 of polishing and a feed mechanism 10 for the polishing solution as illustrated in FIG. 1. The polishing pad 1 is fixed to the polishing table 2 with a double-sided adhesive tape or otherwise. The polishing table 2 and the supporting base 6 are so arranged that the polishing pad 1 and the object 5 be opposite each other, and provided with rotation axes 8 and 9, respectively. On the supporting base 6 side, there is provided a pressing mechanism for pressing the object 5 against the polishing pad 1.

In polishing a wafer surface by the CMP method, it is required to detect, without having to interrupt the progress of polishing, the end point of polishing (the point of time at which the surface structure and the insulating layer thickness of the wafer achieve their respectively desired states). As a way of detecting this end point of polishing, the wafer surface can be irradiated with a laser beam through a polishing pad and the beam reflected from the wafer can be monitored.

The reflected beam from the wafer having an insulating film on the surface contains an interference light resulting from interference between a first reflected light reflected by an insulating film face present on the wafer surface and a second reflected light reflected by a boundary face between the insulating film and a silicon substrate. This interference light has an intensity matching the phasic relationship between the first reflected light and the second reflected light, and this phasic relationship represents the thickness of the insulating film over the silicon substrate. Therefore, the end point of polishing can be detected by monitoring the reflected light from the wafer and analyzing the interference light.

This method for detecting the end point of polishing is described in, for instance, in Japanese Patent Laid-Open No. 9-7985 (U.S. Pat. No. 5,964,643), WO 99/64205 (internationally disclosed after the priority date of the present application), Japanese Patent Laid-Open No. 10-83977 (U.S. Pat. No. 5,893,796), U.S. Pat. No. 6,045,439 and National Publication of International Patent Application No. 11-512977 (U.S. Pat. No. 5,605,760).

Detection of the end point of polishing by this method requires light transmission areas in the polishing pad. A laser beam is brought to incidence on the wafer surface through the light transmission areas of the polishing pad, lights having passed these light transmission areas, out of the reflected lights from the wafer are directed toward a detector.

The references cited above also describe how these light transmission areas are provided. For instance, a through hole is bored in part of the polishing pad, a hole penetrating the table in its thickness direction is bored continuously from the through hole in the pad, and window members, such as transparent sheets, plugs or the like are fitted to these continuous holes. As these window members, members of a uniform structure consisting of quartz, polyurethane or the like (members having no intentionally designed distribution of refractive index) are used.

However, these methods according to the prior art have need for some improvement in the point of view of the efficiency of bringing reflected lights from the wafer to incidence on the photo detector.

As polishing of a wafer cannot completely eliminate non-uniformity on the wafer surface even if the polishing is done to the end point, the reflected lights from the wafer are scattered. If the face of the window member toward the polishing face is more depressed than the polishing face itself, the polishing solution having accumulated in this more depressed part further scatters the reflected lights from the wafer. If the face of the window member toward the polishing face is made level with the polishing face, the face of the window member toward the polishing face may also be polished depending on its material, resulting in further scattering of the reflected lights from the wafer by the face to be polished.

Therefore, even if a light normal to the polishing face is brought to incidence through the window member, the reflected lights from the wafer will not be aligned to the direction normal to the polishing face. As a result, when these reflected lights enter the window member of a uniform structure, part of these reflected lights will be absorbed by, for instance, the inner face of the through hole in the table and fail to reach the detector.

It is conceivable to expand the light transmission area to bring the reflected lights from the wafer to incidence on the photo detector efficiently, but an expansion of the light transmission area would reduce the polishing face of the polishing pad correspondingly. Thus, it is not preferable to expand the light transmission area because it would adversely affect the uniformity of polishing.

To add, WO 99/64205 describes an arrangement in which a laser beam is brought to incidence and reflected lights are received by an optical fiber, one end of this optical fiber is inserted into a through hole bored in the polishing pad, and the other end is connected to a light receiver for detecting the end point of polishing. Thus, in this example, no window member is fitted in the light transmission area of the polishing pad.

An object of the present invention is to make a transparent window member (provided in the light transmission area of a polishing pad for detecting the end point of polishing by a CMP method) a composition which enables reflected lights from a wafer to be efficiently brought to incidence on a photo detector, even if the size of the transparent window member is small.

DISCLOSURE OF THE INVENTION

In order to solve the problems noted above, the present invention provides a polishing pad for chemical mechanical polishing having a polishing area and a light transmission area consisting of a transparent window member within a pad surface, wherein the window member has areas of a high refractive index and areas of a low refractive index in its window face, and each of the areas is alternately arranged in stripes in a cross section normal to the window face.

When a light is brought to incidence on the light transmission area of the polishing pad from one window face, the light travels in the thickness direction of the polishing pad mainly in the areas having a high refractive index while being reflected by the boundary between the areas having a high refractive index and the areas having a low refractive index, and is emitted from the other face. Thus, even if the light coming incident on this light transmission area is not uniform in direction, the light is transmitted substantially in the lengthwise direction of the aforementioned stripes within the light transmission area.

Therefore, this light transmission area, where the incident light is not uniform in direction, can make the degree of diffusion of the light emitted from the light transmission area lower than does a light transmission area of a window member of a uniform structure. Accordingly, this polishing pad can bring a reflected light (light not uniform in direction) from the object of polishing for detecting the end point of polishing to incidence on the photo detector more efficiently than a polishing pad provided with a light transmission area of a window member of a uniform structure.

It is preferable for the polishing pad according to the invention that the arrangement of the areas of a high refractive index and the areas of a low refractive index constituting the window member be a Fresnel zone plate arrangement in which the areas of a high refractive index are matched with the bright area of a Fresnel zone plate and the areas of a low refractive index are matched with the dark area of the Fresnel zone plate.

As the arrangement of the areas of a high refractive index and the areas of a low refractive index constituting the window member of this polishing pad is the Fresnel zone plate arrangement, the window member has a light condensing effect similar to that of a Fresnel zone plate in addition to the aforementioned effect of transmitting the incident light in the light transmission area substantially in the lengthwise direction of the stripes (optical wave-guiding effect). For this reason, when a light is brought to incidence on the light transmission area of this polishing pad from one face, the light emitted from the other face is condensed. Thus, even if the light coming incident on this light transmission area is not uniform in direction, the light emitted from this light transmission area is focused.

Therefore, this polishing pad enables a reflected light (light not uniform in direction) from the object of polishing for detecting the end point of polishing to be emitted from the light transmission area as a focused light. As a result, this light transmission area can bring a reflected light from the object of polishing to incidence on the photo detector more efficiently than a light transmission area of a window member of a uniform structure. Furthermore, it can bring a reflected light from the object of polishing on the photo detector more efficiently than a light transmission area of a window member covered by the invention but having no Fresnel zone plate arrangement.

A Fresnel zone plate, as shown in FIG. 2, is a pattern consisting of a plurality of concentric circles, a first area Z1 corresponding to the inside of a first circle C1 of this pattern, a second area Z2 corresponding to the space between the first circle C1 and a second circle C2, a third area Z3 corresponding to the space between the second circle C2 and a third circle C3 and so forth, the first circle C1, the second circle C2, the third circle C3 and so forth being counted from the center outward, are alternately bright areas (light transmission are as) and dark are as (light intercepting areas). The relationships among the circles C1, C2, C3 and so on are such that the radius Rn of an n-th circle is proportional to the square root of (2n−1). This causes diffracted lights from the bright areas interfere with each other in the same phase to have a light condensing effect.

The focal length of the Fresnel zone plate differs with the wavelength, and the relationship among the radius Rn, the focal length P of each concentric circle and the wavelength λ can be represented by Equation (1) below. Generally, a Fresnel zone plate having a desired focal length is designed by substituting the wavelength λ of the incident light and the desired focal length P into this Equation (1) and thereby deriving the radius Rn of each concentric circle.

$$Rn=\sqrt{(\lambda\cdot P(2n-1)/2)} \quad (1)$$

This Equation (1) is mentioned in, for instance, Keigo Iizuka, Hikari Kogaku (Optical Engineering) (expanded and revised new edition), 1983, Kyoritsu Shuppan Kabushiki Kaisha, p. 68.

A window member of the Fresnel zone plate arrangement according to the invention can also be designed to have a desired focal length by deriving the radius Rn of each concentric circle from this Equation (1). Further in this window member, the first area Z1 of the Fresnel zone plate may be either an area of a high refractive index or an area of a low refractive index, but it should preferably be an area of a high refractive index. By having an area of a high refractive index as the first area Z1, more areas of a high refractive index can be arranged in the window member than where an area of a low refractive index is arranged as the first area Z1, resulting in a higher optical wave-guiding effect.

It is preferable for the window member of the polishing pad according to the invention to have a refractive index difference, represented by "(n1−n2)/n1", of not less than 0.5% but not more than 10%, wherein n1 is the refractive index of the areas of a high refractive index and n2 is the refractive index of the areas of a low refractive index, even more preferably not less than 1% but not more than 10%. Too narrow a refractive index difference would reduce the optical wave-guiding effect.

Where the refractive index difference is greater than 10%, there arise significant differences between the areas of a high refractive index and the areas of a low refractive index in the physical properties of materials, including specific gravity and hardness, though the optical wave-guiding performance does not drop, and accordingly it is made difficult to form the window member to constitute the light transmission area. Also, where the refractive index (n1) of the areas of a high refractive index is too high, the proportion of lights reflected by the surface of the light transmission area increases, which is not desirable.

It is preferable for the polishing pad according to the invention that the proportion of the areas of a high refractive index in the window member be not less than 15% but not more than 90% in terms of their square measure in the window face. If the proportion is less than 15% or more than 90%, the optical wave-guiding effect may become insufficient. Taking account of the relative greatness of the optical wave-guiding effect and the relative ease of fabricating the window member constituting the light transmission area, the preferable range of the proportion not less than 20% but not more than 80%, and an even more preferable range is not less than 50% but not more than 80%.

It is preferable for the polishing pad according to the invention that the areas of a high refractive index in the window member be formed in a columnar shape whose axial direction is normal to the window face, and the diameter of this column be not less than 50 μm but not more than 2000 μm. This polishing pad would provide an especially high optical wave-guiding effect.

If the diameter is less than 50 μm, optical diffraction on the boundary between the areas of a high refractive index and the areas of a low refractive index will become significant, resulting in a reduced optical wave-guiding effect. Also, if the diameter is more than 2000 μm, the optical wave-guiding effect will drop. It is preferable for the diameter be not less than 50 μm but not more than 500 μm, even more preferably not less than 75 μm but not more than 200 μm.

Where the polishing pad according to the invention has the Fresnel zone plate arrangement of the areas of a high refractive index and the areas of a low refractive index, there may either be only one such Fresnel zone plate arrangement or a plurality of such arrangements. Where there are a plurality of such arrangements, it is preferable for the diameter of the outermost ring constituting a bright area of the Fresnel zone plate to be not less than 300 μm but not more than 2000 μm and for the width of this outermost ring to be not less than 10 μm but not more than 200 μm.

If the outer diameter of the outermost ring is less than 300 μm or the width of the outermost ring is less than 10 μm, the impact of diffraction on the refractive index boundary will increase, making it difficult to achieve a light condensing effect similar to that of the Fresnel zone plate. If the outer diameter of the outermost ring is more than 2000 μm or the width of the outermost ring is more than 200 μm, it will also become difficult to achieve a light condensing effect similar to that of the Fresnel zone plate.

A composition in which the window member has only one Fresnel zone plate arrangement would make it possible to reduce the light receiver size, and this would be preferable where a light of a large beam diameter is to irradiate the light transmission area. By contrast, a composition in which the window member has a plurality of Fresnel zone plate arrangements would result in a plurality of light condensing points, and this would provide the advantage of making it possible to receive reflected lights more dependably where reflected lights come incident on only part of the window member face.

It is preferable for the polishing pad according to the invention that the window member constituting the light transmission area consists of cross-linked polymers. Generally, the higher the level of cross linking, the denser the cross-linked polymer. Therefore, it is possible to vary the refractive index of a member consisting of cross-linked polymers by controlling the level of cross linking when polymers are cross-linked. Where the polishing pad according to the invention has a window member consists of cross-linked polymers, the areas of a high refractive index have a higher level of cross linking of polymers than the areas of a low refractive index.

Since cross-linked polymers are chemically stable, a window member consisting of cross-linked polymers is hardly affected by the polishing solution used in the CMP method. Furthermore, if a difference in refractive index is generated by controlling the level of cross linking of polymers, the areas of a high refractive index and the areas of a low refractive index take on a state of firm bonding by chemical bonding. For this reason, a window member consisting of cross-linked polymers can hardly be broken even when subjected to mechanical deformation.

Where the window member of the polishing pad according to the invention is to be formed of cross-linked polymers, photosensitive polymers, for instance, can be used as the cross-linked polymers. By so irradiating the photosensitive polymers with a light that the level of cross linking in the areas of a high refractive index be higher than that in the areas of a low refractive index according to the refractive index distribution on the pad face, a window member having a refractive index distribution can be obtained.

Suitable photosensitive polymers include polyurethane acrylates, epoxy acrylates, polyester acrylates, unsaturated polyesters, rubber acrylates, polyamides, silicon acrylates, alkyd acrylates and cyclized rubbers. Polybutadienes are also preferable because their high resistance to acid and alkali serves to prevent deterioration by the polishing solution used in the CMP method.

Resin mixtures containing one or another of these photosensitive polymers can as well be used. In this case, a desired level of hardness can be given to the photosensitive polymers by adjusting the composition of the resin mixture and the quantities of monomers (acrylates, methacrylates or multifunctional monomers having a vinyl group) to the photosensitive polymers.

It is preferable for the polishing pad according to the invention that the window face of the window member on the polishing face side be in the same plane as the polishing face, and that at least the part of the window member on the polishing face side has no greater hardness than the polishing face, the difference in hardness being no more than 20 in Shore-D hardness index.

This polishing pad, because the window face of the window member on the polishing face side is in the same plane as the polishing face, it is difficult for the polishing solution to stay on the aforementioned window face of the window member. In addition, structures that can prevent the polishing solution from staying on the window face of the window member on the polishing face side include one in which the window face protrudes beyond the polishing face, but this structure involves the problems of impossibility of uniform polishing, difficulty of dressing for maintenance and occurrence of scratch on the face to be polished.

Also, since at least the part of the window member on the polishing face side of this polishing pad is no harder than the polishing face, the window face of the window member on the polishing face side does not protrude beyond the polishing face in the process of polishing. Moreover, as the hardness difference is not more than 20 in Shore-D hardness index, even if the window face of the window member is depressed below the level of the polishing face in the process of polishing, this depression can be kept sufficiently small. A more preferable hardness difference is 10 or less in Shore-D hardness index. Further, at least the part of the window member on the polishing face side of this polishing pad should be hard enough not to be damaged while being polished or dressed.

The invention also provides a light-transmissive sheet having face areas of a high refractive index and areas of a low refractive index in the sheet, and each of the areas is alternately arranged in stripes in a cross section normal to the sheet face.

When a light is brought to incidence on one of the faces of this sheet, the light travels in the thickness direction of the sheet mainly in the areas having a high refractive index while being reflected by the boundary between the areas having a high refractive index and the areas having a low refractive index, and is emitted from the other face. Thus, even if the light coming incident on this light transmission area is not uniform in direction, this light is transmitted substantially Also, since at least the part of the window member on the polishing face side of this polishing pad is no harder than the polishing face, the window face of the window member on the polishing face side does not protrude beyond the polishing face in the process of polishing. Moreover, as the hardness difference is not more than 20 in Shore-D hardness index, even if the window face of the window member is depressed below the level of the polishing face in the process of polishing, this depression can be kept sufficiently small. A more preferable hardness difference is 10 or less in Shore-D hardness index. Further, at least the part of the window member on the polishing face side of this polishing pad should be hard enough not to be damaged while being polished or dressed.

A light-transmissive sheet having face areas of a high refractive index and areas of a low refractive index in the sheet can also be used as a window member of a polishing pad of the present invention, and each of the areas is alternately arranged in stripes in a cross section normal to the sheet face.

When a light is brought to incidence on one of the faces of this sheet, the light travels in the thickness direction of the sheet mainly in the areas having a high refractive index while being reflected by the boundary between the areas having a high refractive index and the areas having a low refractive index, and is emitted from the other face. Thus, even if the light coming incident on this light transmission area is not uniform in direction, this light is transmitted substantially in the lengthwise direction of the aforementioned stripes within the light transmission area.

A sheet of the above described composition may include a sheet wherein the arrangement of the areas of a high refractive index and the areas of a low refractive index in the sheet face is a Fresnel zone plate arrangement in which the areas of a high refractive index are matched with the bright areas of a Fresnel zone plate and the areas of a low refractive index are matched with the dark areas of the Fresnel zone plate. This sheet, by virtue of the arrangement of the areas of a high refractive index and the areas of a low refractive index, has a light condensing effect similar to that of the Fresnel zone plate in addition to the aforementioned optical wave-guiding effect. Thus, when a light is brought to incidence on one face of this sheet, the light emitted from the other face is condensed.

Therefore, by forming an opening in the light transmission area of a polishing pad for CMP use and arranging any one of the sheets described in the opening, a polishing pad according to the invention can be readily formed.

It is preferable for these sheets to be manufactured by a method whereby the areas of a high refractive index and the areas of a low refractive index are formed by varying the level of cross linking of cross-linked molecules in the sheet face.

A polishing pad of the invention may includes a polishing pad for chemical mechanical polishing having polishing areas and a light transmission area consisting of a transparent window member within a pad surface, wherein the face of the reverse side to the polishing face is fixed to a light-transmissive supporting body, a light-transmissive sheet is arranged in an opening formed in the light transmission area, and the whole surface of this sheet is stuck to the supporting body with a light-transmissive adhesive.

Since in this polishing pad the whole surface of the sheet is stuck to the supporting body with an adhesive, infiltration of the polishing solution into the back face of the sheet (the face arranged on the table side) is more effectively prevented than in a polishing pad wherein only the edge of the sheet is stuck to a supporting body. Furthermore, because of the use of the light-transmissive supporting body and adhesive, a light irradiating from the back side of the sheet can be brought to incidence into the sheet more reliably.

The invention also provides a polishing pad of this kind wherein the sheet has the areas of a high refractive index and the areas of a low refractive index in the sheet face, and each of the areas is alternately arranged in stripes in a cross section normal to the sheet face.

The invention also provides a polisher having light irradiating means for irradiating an object of polishing via the light transmission area of a polishing pad with a laser beam of a single wavelength or a light of a narrow wavelength range having passed a band pass filter; light receiving means for receiving, light having passed the light transmission area, out of the reflected lights from a wafer; and end point detecting means for detecting the end point of polishing according to a light reception signal from the light receiving means, wherein the polishing pad is a polishing pad according to the invention.

The invention also provides an end point of polishing detection method which comprises irradiating a wafer surface with a laser beam of a single wavelength or a light of a narrow wavelength range having passed a band pass filter through the light transmission area of a polishing pad, monitoring reflected lights from the wafer through the same light transmission area, wherein the polishing pad used is a polishing pad according to the invention.

BEST MODES FOR CARRYING OUT THE INVENTION

Some of the best modes for carrying out the present invention will be described below.

(First Mode of Carrying Out the Invention for Window Member)

A first mode of implementing the invention for a transparent window member (sheet) to be provided in light transmission areas of a polishing pad will be described below with reference to FIGS. 3 through 7.

<Embodiment 1-1>

Figure 1:
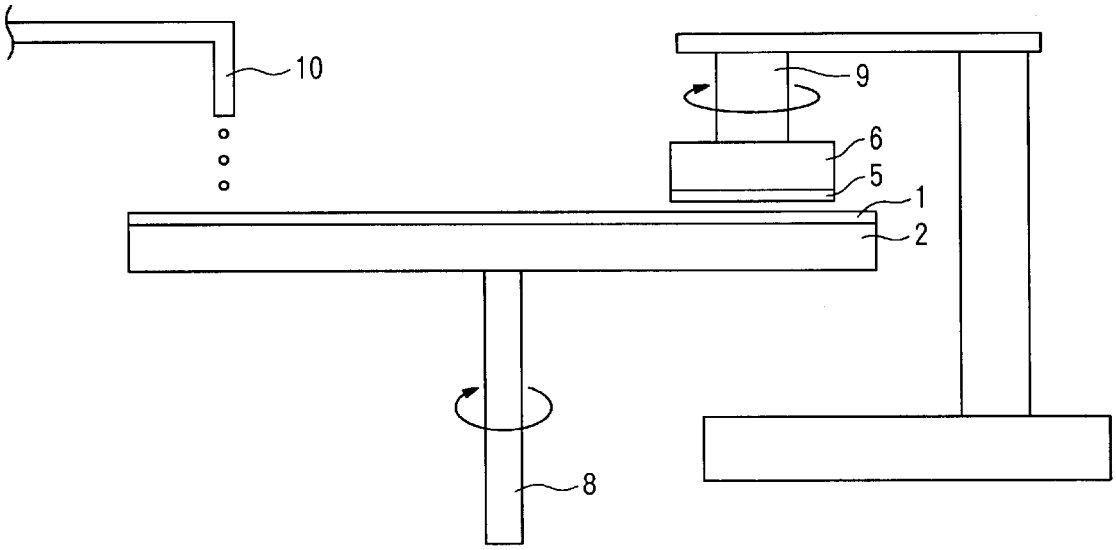
FIG. 1 schematically illustrates the composition of a polisher for use in a CMP method.
Figure 2:
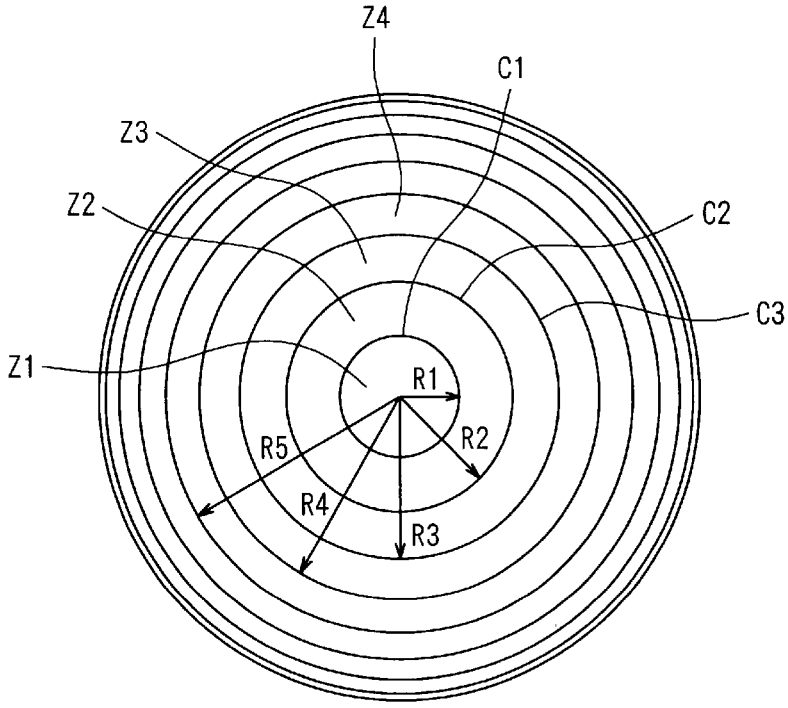
FIG. 2 illustrates a Fresnel zone plate.
Figure 3:
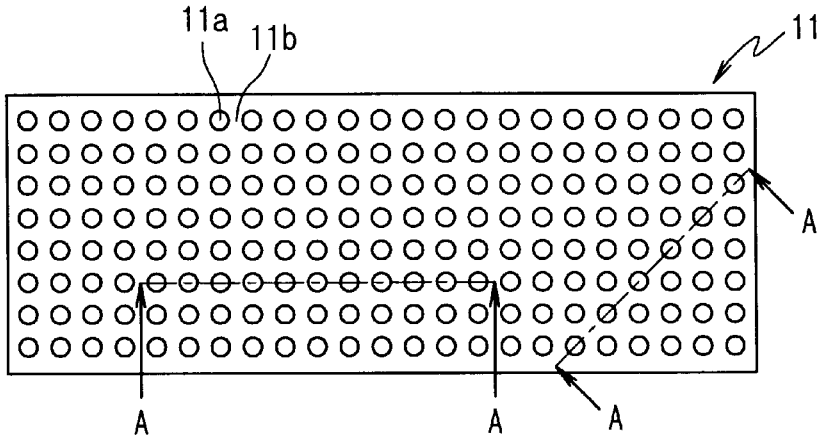
FIG. 3 shows the planar shape of a window member in a first mode of carrying out the invention (Embodiment 1-1 and Embodiment 1-3)
Figure 4:
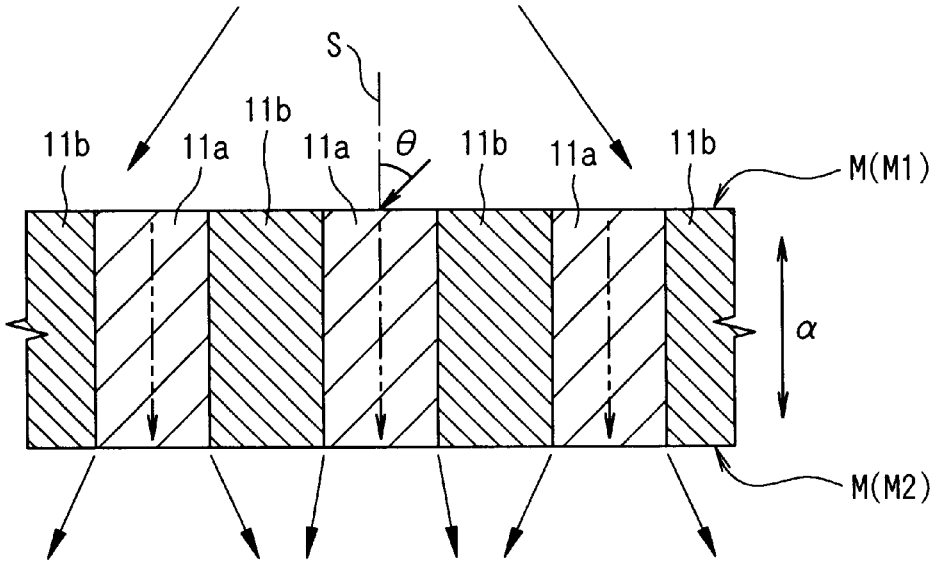
FIG. 4 shows a cross section along line A—A in FIG. 3.

A window member, which is this embodiment, has a planar shape shown in FIG. 3 and a cross sectional shape shown in FIG. 4. FIG. 4 shows a cross section along line A—A in FIG. 3, which is a section normal to the window face of this window member.

This window member 11 has within a window face M areas 11*a* having a high refractive index and areas 11*b* having a low refractive index. In the section normal to the window face M, the areas 11*a* having a high refractive index and the areas 11*b* having a low refractive index are alternately arranged in stripes. The refractive index n1 of the areas 11*a* having a high refractive index is 1.50, while the refractive index n2 of the areas 11*b* having a low refractive index is 1.47. Each of the areas 11*a* having a high refractive index is formed in a columnar shape the direction of whose axis S is in a direction $\alpha$ normal to the window face M.

The areas 11*a* having a high refractive index are circularly shaped in the window face M, and the circles are arrayed in a matrix in the window face M. The diameter of each circle is 200 $\mu$m, and the pitch of the circles (the distance between the centers of adjoining circles) is 400 $\mu$m. The proportion of the areas 11*a* having a high refractive index in this window member 11 is 19% in terms of their square measure in the window face M. The Shore-D hardness of this window member 11 is 45.

As illustrated in FIG. 4, when a light is brought to incidence from one window face M1 of this window member 11, lights whose incident angle $\theta$ to the areas 11*a* having a high refractive index is smaller than the arcsine of the numerical apertures (NA) are emitted from the other window face M2 after being transmitted in a direction $\alpha$ substantially normal to the window face M while being repeatedly reflected by the boundary between the areas 11*a* having a high refractive index and the areas 11*b* having a low refractive index. Incidentally, the numerical apertures (NA) is a value determined only by the refractive indexes n1 and n2 of the areas 11*a* and 11*b*.

<Embodiment 1-2>

Figure 5:
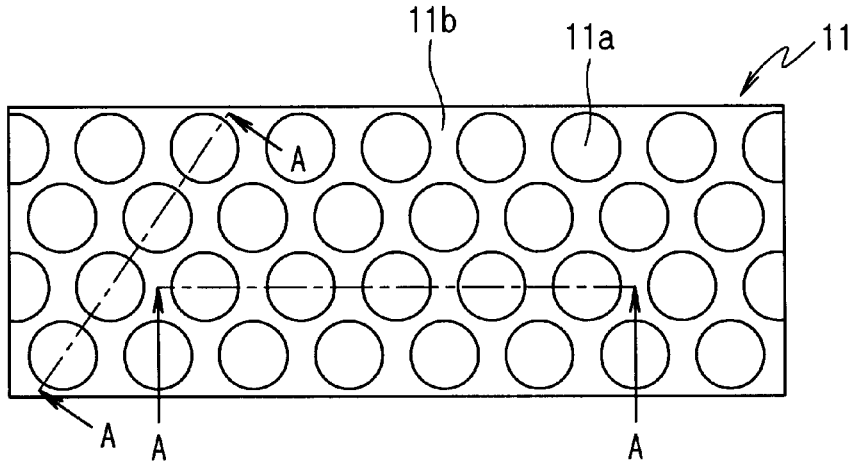
FIG. 5 shows the planar shape of a window member in the first mode of carrying out the invention (Embodiment 1-2)

A window member, which is this embodiment, has a planar shape shown in FIG. 5. The cross section of this window member normal to the window face (the cross section along line A—A) is the same as its counterpart in FIG. 4.

In this window member 11, circles constituting the areas 11*a* having a high refractive index are arrayed in a staggered arrangement in the window face M. The diameter of each circle is 500 $\mu$m, and the pitch of the circles is 532 $\mu$m. The proportion of the areas 11*a* having a high refractive index in this window member 11 is 80% in terms of their square measure in the window face M. This embodiment is the same as Embodiment 1-1 in all other respects.

<Embodiment 1-3>

In a window member 11, which is this embodiment, circles formed by the areas 11*a* having a high refractive index is 40 $\mu$m, and the pitch of the circles is 80 $\mu$m. The proportion of the areas 11*a* having a high refractive index in this window member 11 is 91% in terms of their square measure in the window face M. This embodiment is the same as Embodiment 1-1 in all other respects.

<Embodiment 1-4>

Figure 6:
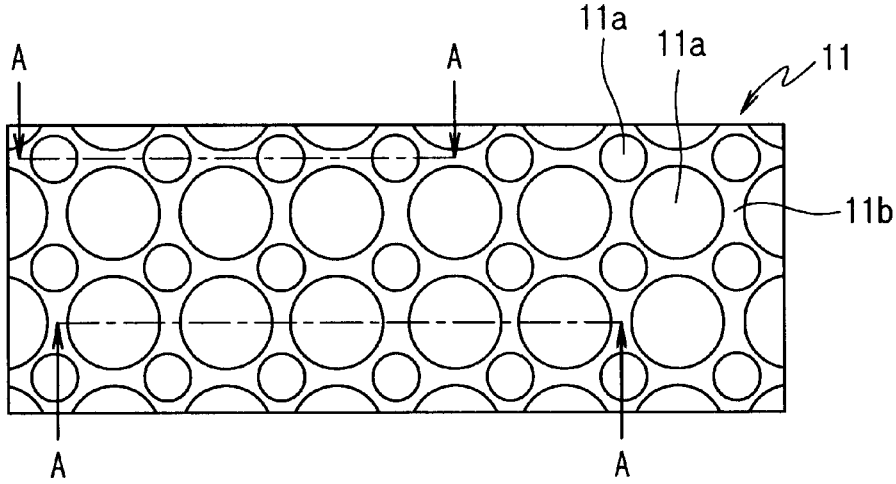
FIG. 6 shows the planar shape of a window member in the first mode of carrying out the invention (Embodiment 1-4)

A window member, which is this embodiment, has a planar shape shown in FIG. 6. The cross section of this window member normal to the window face (the cross section along line A—A) is the same as its counterpart in FIG. 4.

Circles constituting the areas 11*a* having a high refractive index are arrayed in a staggered arrangement in the window face M. Each circle has one of two diameters, 500 $\mu$m or 213 $\mu$m, and the pitch of the circles is 505 $\mu$m. The proportion of the areas 11*a* having a high refractive index in this window member 11 is 91% in terms of their square measure in the window face M. This embodiment is the same as Embodiment 1-1 in all other respects.

<Window Member Fabricating Method>

Figure 7:
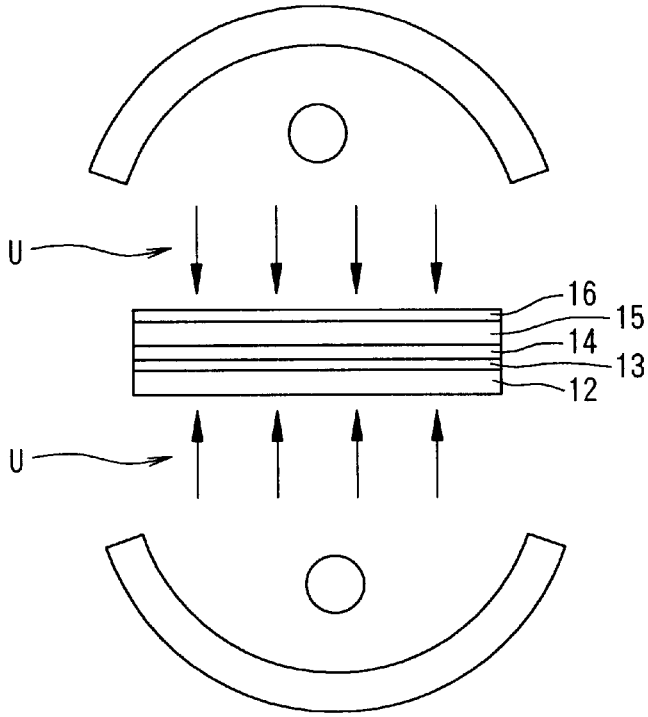
FIG. 7 illustrates a window member fabricating method in first and second modes of carrying out the invention.

The window members 11 embodying the invention as described above were fabricated by the following method. First, as shown in FIG. 7, a photomask 13 is placed over a glass plate 12. On the photomask 13 is drawn a reiterative pattern of circles, matching the arrangement of the areas 11*a* having a high refractive index of each window member 11 to be fabricated, as a light transmission area. Next, a polyester film 14 is placed over this photomask 13, and a liquid film 15 of photosensitive resin is formed over the polyester film 14. A polyester film 16 is placed further over this liquid film 15.

The photosensitive resin used was "APR (registered trade mark) K-11", a liquid photosensitive resin produced by Asahi Kasei Kogyo Kabushiki Kaisha for use in the manufacture of printing plates. This liquid was applied over the polyester film 14 using a doctor blade, and the thickness of the liquid film was adjusted to 1.4 mm. The polyester film 14 over the photomask 13 was used to prevent the photosensitive resin from sticking to the photomask 13.

In this state, two sides including the under side of the glass plate 12 and the top side of the polyester film 16 were irradiated with ultraviolet rays U at a rate of 1000 mJ/cm$^2$ on each side. As a result, the top side of the liquid film 15 is irradiated with ultraviolet rays U all over, while on the under side only the part matching the round light transmission area of the photomask 13 was irradiated with ultraviolet rays.

This causes the photosensitive resin causes the liquid film 15 to be cross-linked by the ultraviolet rays U to become cross-linked polymers, and the part of the liquid film 15 matching the light transmission area of the photomask 13 is cross-linked at a higher level of cross linking than elsewhere. As a result, the refractive index of a sheet that is obtained, consisting of cross-linked polymers, is higher in the part matching the light transmission area of the photomask 13 (the part matching the areas 11*a* having a high refractive index) than in other areas (the part matching the areas 11*b* having a low refractive index).

By cutting out of this sheet, a window member 11 of 56 mm×18 mm×1.4 mm in thickness was obtained.

<Window Member Fabricating Method, for Comparative Example 1>

By the method illustrated in FIG. 7, irradiation with ultraviolet rays was carried out without arranging the photomask 13. In other respects, the same method as that in the first mode of implementation was used. This provided a sheet whose refractive index all over was as high as that of the areas having the high refractive index n1 in the first mode of implementation. By cutting out of this sheet, a window member of 56 mm×18 mm×1.4 mm in thickness was obtained.

<Evaluation of Each Window Member>

Regarding the window members of Embodiments 1-1 through 1-4 and Comparative Example 1, when a diffuse light was brought to incidence from one window face, the state of the emitted light from the other window face was examined. More specifically, a diffuse light obtained by passing a helium neon laser beam (of 633 nm in oscillation wavelength) through frosted glass was brought to incidence on one window face of the window member, the surface of a thin white screen was exposed to the emitted light from the other window face, and the intensity pattern of the emitted light (the light transmitted by the sheet) was observed from the back side of this screen.

As a result, in Embodiments 1-1 and 1-2, a circular, bright spot pattern matching the high refractive index area was recognized in a range wherein the distance between the light emitting face of the window member and the screen was no more than about 2 cm. In Embodiments 1-3 and 1-4, circular, bright spot pattern matching the high refractive index area was not recognized.

As the window members (sheets) of Embodiments 1-1 through 1-4 have the aforementioned optical wave-guiding effect and accordingly can emit the incident diffuse light with its degree of diffusion reduced, the intensity of the emitted light proved higher than that of the uniformly structured window member (sheet) of Comparative Example 1. Especially in Embodiments 1-1 and 2-2, where the optical wave-guiding effect is greater, a bright spot pattern was recognized in the distance range of no more than about 2 cm.

(Second Mode of Carrying Out the Invention for Window Member)

A second mode of implementing the invention for a transparent window member (sheet) to be provided in light transmission areas of a polishing pad will be described below with reference to FIGS. 8 through 11.

<Embodiment 2-1>

Figure 8:
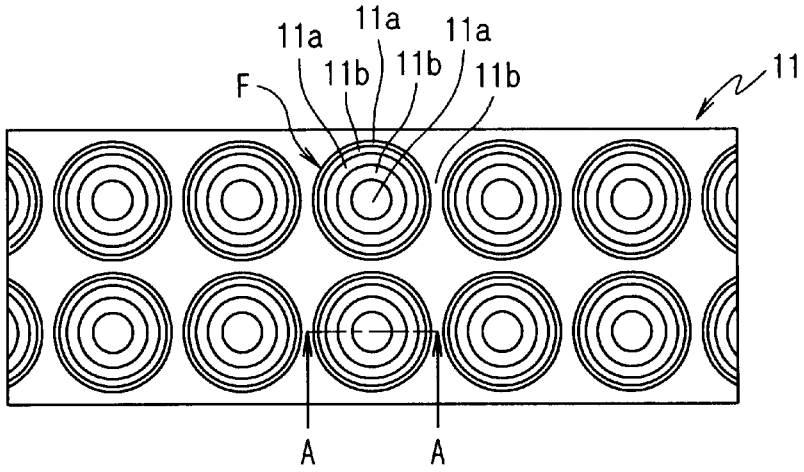
FIG. 8 shows the planar shape of a window member in a second mode of carrying out the invention (Embodiments 2-1, 2-2 and 2-4)
Figure 9:
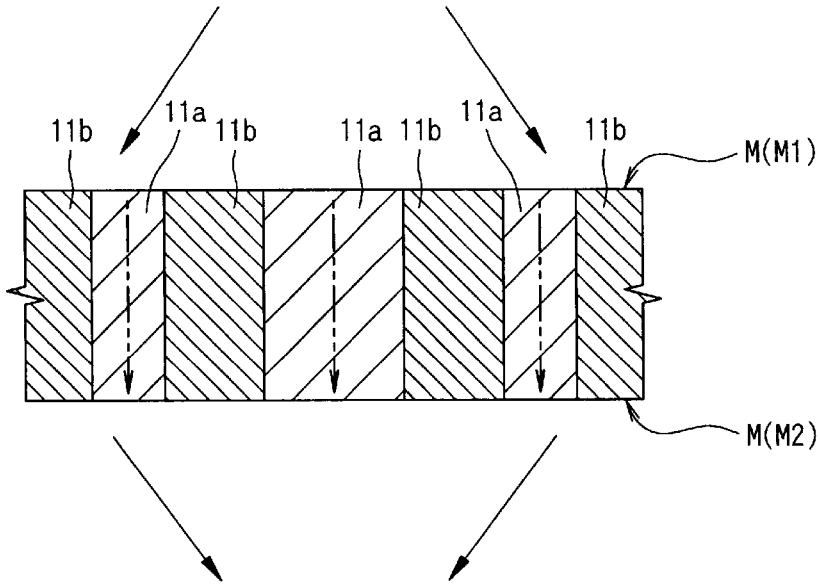
FIG. 9 shows a cross section along line A—A in FIG. 8.

A window member, which is this embodiment, has a planar shape shown in FIG. 8 and a cross sectional shape shown in FIG. 9. FIG. 9 shows a cross section along line A—A in FIG. 8, which is a section normal to the window face of this window member.

This window member 11 has areas 11*a* having a high refractive index and areas 11*b* having a low refractive index within a window face M. In the section normal to the window face M, the areas 11*a* having a high refractive index and the areas 11*b* having a low refractive index are alternately arranged in stripes. The refractive index n1 of the areas 11*a* having a high refractive index is 1.50, while the refractive index n2 of the areas 11*b* having a low refractive index is 1.47.

The arrangement of the areas 11*a* having a high refractive index and the areas 11*b* having a low refractive index in the window face M is a Fresnel zone plate arrangement in which a first area Z1 is supposed to be a bright area (the areas 11*a* having a high refractive index). A Fresnel zone plate F constituting this Fresnel zone plate arrangement is a pattern consisting of five concentric circles. A plurality of such Fresnel zone plates F are arrayed in a matrix in the window face M of the window member 11. The distance between the centers of adjoining Fresnel zone plates F is 840 $\mu$m.

The radius of each concentric circle constituting a Fresnel zone plate F was calculated by Equation (1) given above, with the focal length being supposed to be 50 mm and the wavelength, 633 nm. In each of the Fresnel zone plates F, the outer diameter of the outermost ring (the diameter of the fifth circle) is 755 $\mu$m and the width of the outermost ring (the radial difference between the fifth circle and the fourth circle) is 44 $\mu$m.

The proportion of the areas 11*a* having a high refractive index in this window member 11 is 35% in terms of their square measure in the pad face M. The Shore-D hardness of this window member 11 is 45.

As shown in FIG. 9, when a light is brought to incidence from one window face M1 of this window member 11, the light condensing effect similar to that of Fresnel zone plates enables, even if the incident light is not uniform in direction, the emitted light from the other window face M2 to be condensed at the designed focal length.

<Embodiment 2-2>

A window member 11, which is this embodiment, is basically the same as Embodiment 2-1. Its differences from Embodiment 2-1 will be described below.

The distance between the centers of adjoining Fresnel zone plates F is 2210 $\mu$m. The radius of each concentric circle constituting a Fresnel zone plate F was calculated by Equation (1) given above, with the focal length being supposed to be 51 mm and the wavelength, 633 nm. In each of the Fresnel zone plates F, the outer diameter of the outermost ring (the diameter of the fifth circle) is 2000 $\mu$m and the width of the outermost ring (the diametric difference between the fifth circle and the fourth circle) is 118 $\mu$m. The proportion of the areas 11*a* having a high refractive index in this window member 11 is 36% in terms of their square measure in the pad face M.

<Embodiment 2-3>

Figure 10:
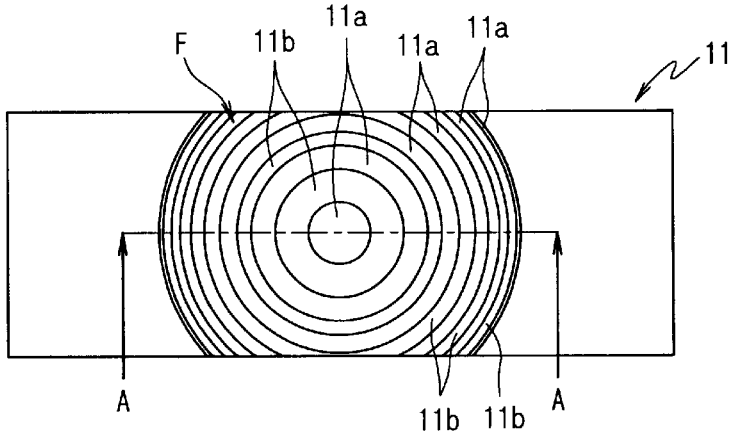
FIG. 10 shows the planar shape of a window member in the second mode of carrying out the invention (Embodiment 2-3)

A window member, which is this embodiment, has a planar shape shown in FIG. 10. A cross section normal to the window face of this window member (a section along line A—A) is the same as in FIG. 9.

In this window member 11, the arrangement of the areas 11*a* having a high refractive index and the areas 11*b* having a low refractive index in the window face M is a Fresnel zone plate arrangement in which a first area Z1 is supposed to be a bright area (the areas 11*a* having a high refractive index). A Fresnel zone plate F constituting this Fresnel zone plate arrangement is a pattern consisting of 81 concentric circles. One such Fresnel zone plate F is arranged in the window face M of the window member 11. Incidentally in FIG. 10, the first 11 circles are represented, and the illustration of the circles farther out is dispensed with.

The radius of each concentric circle constituting a Fresnel zone plate F was calculated by Equation (1) given above, with the focal length being supposed to be 505 mm and the wavelength, 633 nm. In the Fresnel zone plate F, the outer diameter of the outermost ring (the diameter of the 81st circle) is 10.2 mm and the width of the outermost ring (the diametric difference between the 80th circle and the 81st circle) is 32 $\mu$m.

The window face dimensions of this window member 11 are 2.5 mm×10.2 mm, and the proportion of the areas 11*a* having a high refractive index in this window member 11 is 49% in terms of their square measure in the window face M. The Shore-D hardness of this window member 11 is 45.

<Embodiment 2-4>

A window member 11, which is this embodiment, is basically the same as Embodiment 2-1. Its differences from Embodiment 2-1 will be described below.

The distance between the centers of adjoining Fresnel zone plates F is 221 $\mu$m. The radius of each concentric circle constituting a Fresnel zone plate F was calculated by Equation (1) given above, with the focal length being supposed to be 3.5 mm and the wavelength, 633 nm. In each of the Fresnel zone plates F, the outer diameter of the outermost ring (the diameter of the fifth circle) is 200 μm and the width of the outermost ring (the diametric difference between the fifth circle and the fourth circle) is 11 μm. The proportion of the areas 11*a* having a high refractive index in this window member 11 is 36% in terms of their square measure in the pad face M.

<Window Member Fabricating Method>

As a photomask 13, one in which a pattern matching the arrangement of the areas 11*a* having a high refractive index was drawn as a light transmission area was used for each window member 11 to be fabricated, and irradiated with ultraviolet rays by the method shown in FIG. 7. For Embodiment 2-3, the sheet was cut into a size of 10.2 mm×2.5 mm. The method was the same in all other respects as that in the first mode of implementation.

<Evaluation of Each Window Member>

Regarding the window members of Embodiments 2-1 through 2-4, when a diffuse light was brought to incidence from one window face, the state of the emitted light from the other window face was examined in the same manner as in the first mode of implementing the invention. Light intensities were detected in a position of 100 cm in distance from the light emitting face of the window member.

As a result, in Embodiment 2-1, a pattern consisting of a plurality of bright spots attributable to the light condensing effect of each Fresnel zone plate was recognized in a range wherein the distance between the light emitting face of the window member and the screen was no more than about 10 cm. In Embodiment 2-2, a pattern consisting of a plurality of bright spots attributable to the light condensing effect of each Fresnel zone plate was recognized in a range wherein the distance between the light emitting face of the window member and the screen was no more than about 100 cm.

In Embodiment 2-3, a bright spot attributable to the light condensing effect of each Fresnel zone plate was recognized in a range wherein the distance between the light emitting face of the window member and the screen was no more than about 100 cm. In Embodiment 2-4, no pattern consisting of a plurality of spots was recognized.

The detected value of light intensity was 30 nW in Comparative Example 1, 120 nW in Embodiment 2-2, and 130 nW in Embodiment 2-3.

Figure 11:
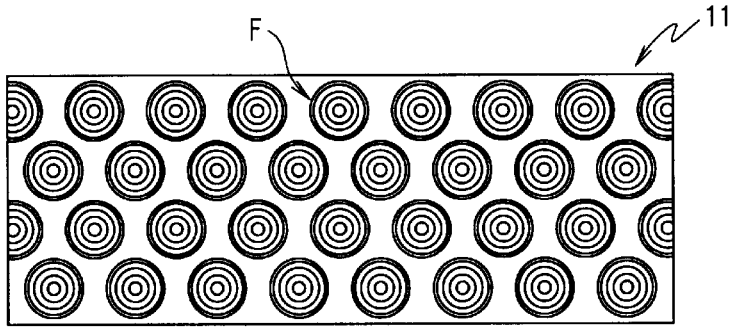
FIG. 11 shows the planar shape of a window member in the second mode of carrying out the invention.

As the window members (sheets) of Embodiment 2-1 through 2-4 can receive diffuse lights and emit them as focused lights, the intensity of the emitted light proved higher than that of the uniformly structured window member (sheet) of Comparative Example 1. Especially in Embodiments 2-1 and 2-3, the optical wave-guiding effect was greater than that in Embodiment 2-4, and satisfactory light condensing performance was achieved.

Where there are a plurality of Fresnel zone plate arrangements within the pad face of the window member 11, as shown in FIG. 11 the patterns of the Fresnel zone plates F may as well be arranged in a staggered manner. Also, where there are a plurality of Fresnel zone plate arrangements within the pad face of the window member 11, Fresnel zone plate patterns differing in size from one another can be arranged.

(Third Mode of Carrying Out the Invention for Window Member)

Figure 12:
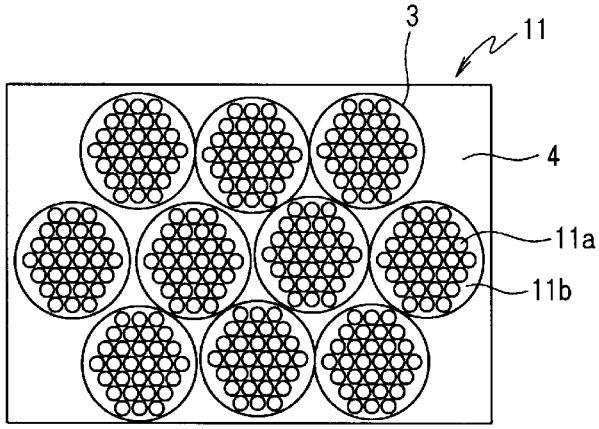
FIG. 12 shows the planar shape of a window member in a third mode of carrying out the invention.
Figure 13:
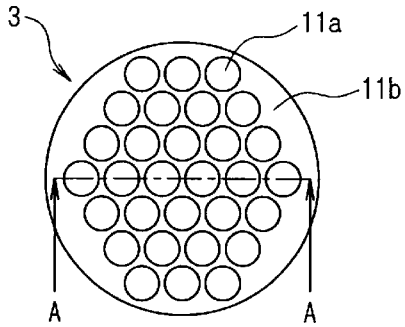
FIG. 13 shows a cross section of a multi-core optical fiber constituting part of the window member of FIG. 12.

FIG. 12 shows the planar shape of a transparent window member (sheet) to be provided in the light transmission area of a polishing pad in a third mode of carrying out the invention. FIG. 13 shows a cross section of a multi-core optical fiber constituting part of this window member. A cross section along line A—A in FIG. 13 (corresponding to a section normal to the window face of the window member in FIG. 12) is the same as its counterpart in FIG. 4.

A window member 11 in this mode of implementation is fabricated by fixing a plurality of multi-core optical fibers 3 shown in FIG. 13, stacked one over another, with an adhesive 4 and slicing this stack into a piece of a prescribed thickness in a direction at a right angle to the lengthwise directions of the optical fibers 3. Each of the multi-core optical fibers 3 has many cores corresponding to the areas 11*a* having a high refractive index in a clad corresponding to the areas 11*b* having a low refractive index.

Therefore, this window member 11 has in its window face the areas 11*a* having a high refractive index and the areas 11*b* having a low refractive index for each optical fiber 3. As shown in FIG. 4, in a cross section normal to the window face M, the areas 11*a* having a high refractive index and the areas 11*b* having a low refractive index are arranged alternately in stripes.

As illustrated in FIG. 4, when a light is brought to incidence from one window face M1 of this window member 11, lights whose incident angle θ to the cores 11*a* of the multi-core optical fibers 3 (the areas having a high refractive index) is smaller than the arcsine of the numerical apertures (NA) are emitted from the other window face M2 after being transmitted in a direction α substantially normal to the window face M in the cores 11*a*.

As the multi-core optical fibers 3, for instance, multi-core plastic optical fibers "Multicore (registered trade mark) POF (registered trade mark) Grade M" produced by Asahi Kasei Kogyo Kabushiki Kaisha (1 mm in core diameter, 0.5 in number of apertures (NA), 217 in number of cores, 1.49 in refractive index of core, and 1.41 in refractive index of clad) can be used.

Many such optical fibers are bundled in the most densely filled structure and put into a frame whose inner dimensions measure 56 mm×18 mm, and the gaps between the bundle of optical fibers and the frame were filled with solvent-less silicon resin of 1.41 in refractive index. By slicing this bundle into a piece of 1.4 mm in thickness, a window member 11 of 56×mm×18 mm×1.4 mm (thickness) was obtained.

Regarding this window member 11, when a diffuse light was brought to incidence from one window face, the state of the emitted light from the other window face was examined in the same manner as in the first mode of implementing the invention. As a result, a pattern consisting of a plurality of bright spots matching the arrangement of the cores of the multi-core optical fibers was recognized in a range wherein the distance between the light emitting face of the window member and the screen was no more than about 2 cm.

Further, as this window member 11 has the aforementioned optical wave-guiding effect and accordingly can emit the incident diffuse light with its degree of diffusion reduced, the intensity of the emitted light proved higher than that of the uniformly structured window member (sheet) of Comparative Example 1.

(Fabricating Method of Polishing Pad)

By fixing any of the window members 11 thus obtained in the first through third modes of implementing the invention to an opening formed in the light transmission area of a polishing pad, the polishing pad can be finished.

In this mode of implementation, the polishing pad was fabricated by a method described below. First, a sheet of 1.1 mm in thickness was formed by extrusion molding of polyvinylidene fluoride (168° C. in melting point, 2.9 in MFR (230° C., 12.5 kg)) under heating. Next, this sheet was cross-linked by irradiation with an electron beam of 11 Mrad using a 500 KV electron beam irradiator.

Then, this cross-linked sheet was put into a pressure vessel, into which tetrafluoroethane was injected as a foaming agent, and the mixture was held at 70° C. for 30 hours. The cross-linked sheet was thereby impregnated with the foaming agent. This sheet was foamed by holding it in a heating furnace equipped with a far infrared heater at a temperature of 200° C. The foaming magnification of the foamed sheet thereby obtained was 2.3 times, and the average foam diameter was 80 $\mu$m.

Next, both sides of this foamed sheet was buffed with a #240 belt grinder to reduce the sheet thickness to 1.4 mm, following by cutting to a desired size. Grooves shaped in concentric circles (each groove measuring 0.2 mm in width and 0.5 mm in depth, with a groove pitch of 1.5 mm) were formed in this polishing pad by cutting, resulting in a grooved polishing pad. The Shore-D hardness of this grooved polishing pad was 50.

Figure 14:
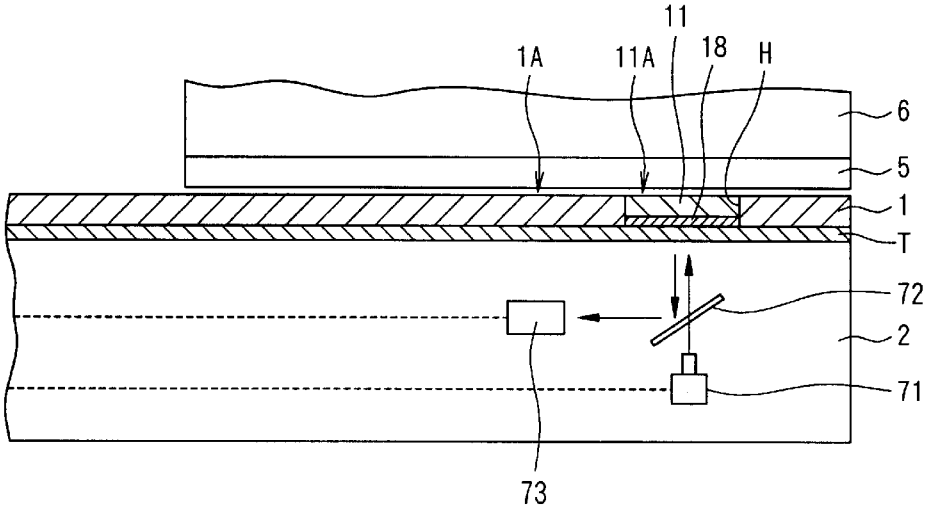
FIG. 14 is a partial cross section of a polisher corresponding to one mode of carrying out the invention.

Then, as shown in FIG. 14, a hole H of 56 mm×18 mm (except in the window member of Embodiment 2-3, where the hole size is 10.2 mm×2.5 mm) was bored in the position of the light transmission area in the pad face of this polishing pad 1. A double-sided adhesive tape T was stuck to the back face (the face of the reverse side to the polishing face) all over of this polishing pad 1. The base film (supporting body) and both adhesive layers of this double-sided adhesive tape T all consist of light transmitting materials. In this state, an adhesive layer of the double-sided adhesive tape T is exposed in the hole H part of the polishing pad 1 and, after applying a light transmitting adhesive 18 to this exposed face, the window member 11 was inserted into the hole H and pressed from above.

In this way, there was obtained a polishing pad 1 in which the window face 11A on the polishing face side of the window member 11 was in the same plane as the polishing face 1A. Fixing this polishing pad 1 to the upper face of the polishing table 2 with double-sided adhesive tape T provides a polisher.

In this embodiment, there are provided within the polishing table 2 a light irradiating device (light irradiating means) 71, a beam splitter (light irradiating means and light receiving means) 72, a light receiver (light receiving means) 73, a control device (light irradiating means) connected to the light irradiating device 71, and an end point detector (end point detecting means) connected to the light receiver 73 and so on. The polishing pad 1 is fitted to the polishing table 2 in such a way that the hole H in the polishing pad and the position of this light irradiating device 71 meet each other.

Therefore according to the polishing pad 1 assembled in this embodiment, a reflected light (light not uniform in direction) from the object of polishing for detecting the end point of polishing can be reduced in degree of diffusion, where the window member 11 in the first or third mode of implementation is used, or focused where the window member 11 in the second mode of implementation is used, when the light is emitted from the window member 11.

Accordingly, the polishing pad 1 assembled in this mode of implementation can bring a reflected light from the object of polishing to incidence on the light receiver 73 more efficiently than a polishing pad provided with a uniformly structured window member. Also, the polishing pad 1 assembled in this mode of implementation can prevent the polishing solution from infiltrating into the back face of the window member 11.

Further, a polishing pad 1 using a window member 11 in either the first or second mode of implementation, as the Shore-D hardness of its window member 11 is 45, the difference in Shore-D hardness between the window face 11A and the polishing face 1A is 5. When this polishing pad 1 was used for polishing a wafer whose top layer is a tetraethylorthosilicate (TEOS) film under usual conditions, the window member 11 suffered no damage while it was being polished.

By contrast, when a polishing pad fitted with a window member of 15 in Shore-D hardness, in place of using a window member in either the first or second mode of implementation, was used, the difference in hardness between the window face 11A and the polishing face 1A reached 35 in Shore-D index. When this polishing pad was used for polishing the same wafer as the aforementioned under the same conditions, this window member was damaged while it was being polished.

Moreover, a window member in any of the first through third modes of implementation, as it can bring a reflected light from the object of polishing for detecting the end point of polishing to incidence on the photo detector more efficiently than a window member according to the prior art, can be reduced in size without sacrificing its effectiveness. Therefore, even in a composition in which a plurality of window members are provided on the pad surface and the end point of polishing is detected in a plurality of positions, the uniformity of polishing can be secured because it is possible to secure a large polishing face for the polishing pad. This composition would make it possible to further enhance the precision of detecting the end point of polishing.

INDUSTRIAL APPLICABILITY

As hitherto described, a polishing pad according to the present invention, by using a window member having an intentionally designed distribution of refractive index, enables a reflected light (light not uniform in direction) from the object of polishing for detecting the end point of polishing to be efficiently brought to incidence on a photo detector even if the size of the window member is small. As a result, it is made possible to accurately detect the end point of polishing by securing a large polishing face of the polishing pad and thereby securing the uniformity of polishing.

What is claimed is:

1. A polishing pad for chemical mechanical polishing having, within a surface of the pad, at least one polishing area and at least one light transmission area consisting of a transparent window member, wherein:

the window member has areas of a high refractive index and areas of a low refractive index and the areas of low refractive index and the areas of high refractive index are arranged so that in a cross-section of the window member the high refractive index areas and the low refractive index areas appear alternately along the direction parallel to the surface of the pad at any level in the cross-section through the depth of the window member.

2. The polishing pad, as set forth in claim 1, wherein the arrangement of the areas of a high refractive index and of a low refractive index constituting the window member is a Fresnel zone plate arrangement in which in the light transmission area the high refractive index areas and the low refractive index areas appear alternately as concentric rings.

3. The polishing pad, as set forth in claim 1 or 2, wherein the ratio between the total area of the high refractive index areas and the total light transmission area is not less than 15% but not more than 90%.

4. The polishing pad, as set forth in claim 1, wherein the areas of a high refractive index in the window member are formed in a cylindrical shape whose axial direction is normal to the surface of the pad and whose diameter is not less than 50 μm but not more than 2000 μm.

5. The polishing pad, as set forth in claim 2, having a plurality of arrangement of the areas of a high refractive index and the areas of a low refractive index, each arrangement being the Fresnel zone plate arrangement, wherein the outermost bright ring of the Fresnel zone plate has a diameter of not less than 300 μm but not more than 2000 μm and a width of not less than 10 μm but not more than 200 μm.

6. The polishing pad, as set forth in claim 2, having only one Fresnel zone plate arrangement.

7. The polishing pad, as set forth in any of claims 1, 2, 4, 5 and 6, wherein the window member consists of cross-linked polymers and the areas of a high refractive index have a higher level of cross linking than the areas of a low refractive index.

8. The polishing pad, as set forth in any of claims 1, 2, 4, 5 and 6, wherein the window face of the window member in the surface of the pad is in the same plane as the polishing area, and the window member at least in the part at the window face has no greater hardness than the polishing face, the difference in hardness being no more than 20 in Shore-D hardness index.

9. A polisher comprising light irradiating means for irradiating an object of polishing via the light transmission area of a polishing pad with a laser beam of a single wavelength or a light of a narrow wavelength range having passed a band pass filter; light receiving means for receiving, light having passed said light transmission area, out of the reflected lights from a wafer; and end point detecting means for detecting the end point of polishing according to a light reception signal from the light receiving means, wherein:

the polishing pad is the polishing pad set forth in any one of claim 1, 2, 4, 5 and 6.

10. An end point of polishing detection method which comprises irradiating a wafer surface with a laser beam of a single wavelength or a light of a narrow wavelength range having passed a band pass filter through the light transmission area of a polishing pad, and monitoring reflected lights from the wafer through the same light transmission area, wherein:

the polishing pad set forth in any one of claims 1, 2, 4, 5 and 6 is used.

11. The polishing pad, as set forth in claim 3, wherein the window member consists of cross-linked polymers and the areas of a high refractive index have a higher level of cross-linking than the areas of a low refractive index.

12. The polishing pad, as set forth in claim 3, wherein the window face of the window member in the surface of the pad is in the same plane as the polishing area, and the window member at least in the part at the window face has no greater hardness than the polishing face, the difference in hardness being no more than 20 in Shore-D hardness index.

13. The polishing pad, as set forth in claim 7, wherein the window face of the window member in the surface of the pad is in the same plane as the polishing area, and the window member at least in part at the window face, has no greater hardness than the polishing face, the difference in hardness being no more than 20 in Shore-D hardness index.

14. A polisher comprising light irradiating means for irradiating an object of polishing via the light transmission area of a polishing pad with a laser beam of a single wavelength or a light of a narrow wavelength range having passed a band pass filter; light receiving means for receiving, light having passed said light transmission area, out of the reflected lights from a wafer; and end point detecting means for detecting the endpoint of polishing according to a light reception signal from the light receiving means, wherein:

the polishing pad is the polishing pad set forth in claim 3.

15. A polisher comprising light irradiating means for irradiating an object of polishing via the light transmission area of a polishing pad with a laser beam of a single wavelength or a light of a narrow wavelength range having passed a band pass filter; light receiving means for receiving, light having passed said light transmission area, out of the reflected lights from a wafer; and end point detecting means for detecting the endpoint of polishing according to a light reception signal from the light receiving means, wherein:

the polishing pad is the polishing pad set forth in claim 7.

16. A polisher comprising light irradiating means for irradiating an object of polishing via the light transmission area of a polishing pad with a laser beam of a single wavelength or a light of a narrow wavelength range having passed a band pass filter; light receiving means for receiving, light having passed said light transmission area, out of the reflected lights from a wafer; and end point detecting means for detecting the endpoint of polishing according to a light reception signal from the light receiving means, wherein:

the polishing pad is the polishing pad set forth in claim 8.

17. An endpoint of polishing detection method which comprises irradiating a wafer surface with a laser beam of a single wavelength or a light of a narrow wavelength range having passed a band pass filter through the light transmission area of a polishing pad, and monitoring reflected lights from the wafer through the same light transmission area, wherein:

the polishing pad set forth in claim 3 is used.

18. An endpoint of polishing detection method which comprises irradiating a wafer surface with a laser beam of a single wavelength or a light of a narrow wavelength range having passed a band pass filter through the light transmission area of a polishing pad, and monitoring reflected lights from the wafer through the same light transmission area, wherein:

the polishing pad set forth in claim 7 is used.

19. An endpoint of polishing detection method which comprises irradiating a wafer surface with a laser beam of a single wavelength or a light of a narrow wavelength range having passed a band pass filter through the light transmission area of a polishing pad, and monitoring reflected lights from the wafer through the same light transmission area, wherein:

the polishing pad set forth in claim 8 is used.

20. A polishing pad for chemical polishing having within a surface of the pad, at least one polishing area and at least one light transmission area consisting of a transparent window member, wherein:

the pad is fixed to a light-transmissive supporting body, and the transparent window member is a light-transmissive sheet arranged in an opening formed in the pad and stuck to the supporting body by means of a light-transmissive adhesive;

the sheet has the areas of a high refractive index and of a low refractive index which are arranged so that in a cross-section of the sheet the high refractive index areas and the low refractive index areas appear alternately along the direction parallel to the surface of the pad at any level in the cross-section through the depth of the sheet.

* * * * *